US007135960B2

(12) United States Patent
Arcaria et al.

(10) Patent No.: US 7,135,960 B2
(45) Date of Patent: Nov. 14, 2006

(54) METHOD AND APPARATUS FOR INDICATING A STATUS

(75) Inventors: Angelo Arcaria, Wethersfield, CT (US); Kenneth R. Taylor, Ivoryton, CT (US); Scott Greco, Middletown, CT (US)

(73) Assignee: GE Security, Inc., Bradenton, FL (US)

( * ) Notice: Subject to any disclaimer, the term of this patent is extended or adjusted under 35 U.S.C. 154(b) by 65 days.

(21) Appl. No.: 10/919,351

(22) Filed: Aug. 17, 2004

(65) Prior Publication Data

US 2006/0038696 A1 Feb. 23, 2006

(51) Int. Cl.
*G08B 3/00* (2006.01)

(52) U.S. Cl. ..... 340/384.1; 340/691.1; 340/815.45; 340/815.65

(58) Field of Classification Search ..... 340/384.1, 340/574, 691.1, 691.2, 691.3, 691.4, 691.5, 340/692, 815.45, 691.6, 815.65, 815.66, 340/384.7

See application file for complete search history.

(56) References Cited

U.S. PATENT DOCUMENTS

| | | | | |
|---|---|---|---|---|
| 5,132,659 | A * | 7/1992 | Kuo | 340/326 |
| 5,557,294 | A * | 9/1996 | Leslie | 345/32 |
| 5,767,777 | A * | 6/1998 | Whitehead | 340/632 |
| 5,825,280 | A * | 10/1998 | Merendini et al. | 340/326 |
| 6,097,300 | A * | 8/2000 | Wei | 340/693.5 |
| 6,139,170 | A * | 10/2000 | Wiggerman | 362/477 |
| 6,144,309 | A * | 11/2000 | Fagence | 340/691.1 |
| 6,417,772 | B1 * | 7/2002 | Right et al. | 340/573.1 |
| 6,646,566 | B1 * | 11/2003 | Tanguay | 340/815.4 |

* cited by examiner

*Primary Examiner*—Toan N. Pham
(74) *Attorney, Agent, or Firm*—Baker & Hostetler LLP

(57) ABSTRACT

A method and apparatus for a signaling device includes an audio device that generates either or both an audible output such as a tone and a voice. The output is based upon a status level. The signaling device further includes a light emitting diode (LED) strobe that illuminates in a variety of colors, where the illumination of a specific color is based upon the status level.

21 Claims, 3 Drawing Sheets

METHOD AND APPARATUS FOR INDICATING A STATUS

FIELD OF THE INVENTION

The present invention relates generally to signaling devices. More particularly, the present invention relates to providing configurable multi-audio and multi-visual alerts to indicate an event or status level.

BACKGROUND OF THE INVENTION

There are a number of signaling devices on the market today. The primary purpose of these signaling devices is to provide some sort of output such that it alerts anyone within its reach of a particular event. One of the most common types of signaling devices is a visual device such as a white strobe. These devices are common place within fire emergency systems. Upon activation of these devices, the white strobe is illuminated such that it is seen or visualized by individuals within the area. The inherent problem with sole visualization warning devices is that there are not easily detected in all areas. Secondly, these sole visualization devices are effective for those individuals that are not visually impaired.

Other prior art devices use single color illumination devices to warn of a specific event. For example, emergency phones or communication devices on college campuses are identified or located with the blue strobe. If the need arises, an individual is able to identify these device from its blue illumination. However, like the previous devices, the illumination is not easily detected or seen from certain areas or angles. Secondly, these illumination devices are limited by which colors they are able to activate. As a result, these illumination devices can only indicate a single event or status. In the case of an emergency, the single event is the location of the phone. These devices are not able to illuminate functional status by altering the illumination color.

The downside to visual only type indication is that the indicator is not necessarily viewable to the end user at allow times. Many times the indicator is located behind a wall or machine or located on a machine not in the line of sight of the operator. The effectiveness of the indicator is thereby greatly reduced.

Incandescent visual devices are further hampered by their short life span especially if they are activated on a number of occasions for any reasons. This short life span makes maintenance and upkeep in locations like office buildings and industrial complexes very difficult. These locations literally contain hundreds to thousands of these devices.

The audio devices are separate devices from the visual indicators and are generally linked to a similar system. These devices require their only special wiring and mounted location. These requirements both add complexity and expense to the overall systems.

Other prior art signaling devices are audio in nature. These devices, similar to the visual devices, are hooked to a central station. Upon activation, the audio device or speaker delivers an output. The audio sounds generated through the device are intended to be heard by individuals within the area to warn them of a particular event or status.

The problem or disadvantage with the aforementioned devices is that they either generate a tone or transmit an audio sound. These prior art devices are not capable of generating both tone and voice messages in a single device.

Another inherent problem with sole audio device is its ability to communicate its message to those within the area.

Accommodations within the area can greatly effect the distance to which the audio signal is transmitted. Therefore, the accommodations in the area have to be taken into account when installing the device. Furthermore, the audio signal is less effective on those individuals that are hearing impaired and in those locations that have high levels of noise such as assembly lines or machine shops.

In order to offer the advantages of both devices and counter the disadvantages of both the devices, many locales in the United States or other parts of the world require that office building and industrial locations be equipped with both visual and audio locators. Accordingly, it is desirable to provide a method and apparatus that offers both the capabilities of audio and visual alerts or indications in a single device such that each capability can be activated together or separately. Furthermore, there is a need to provide a visual indicator that is able to illuminate in a variety of colors in order to indicate a plurality of events or status. Additionally, there is a need to provide an audio device that is able to provide prerecorded tones or voice.

SUMMARY OF THE INVENTION

The foregoing needs are met, to a great extent, by the present invention, wherein in one aspect an apparatus is provided that in some embodiments a single device is able to provide both audio and visual indications such that an event or status level is indicated to those individuals within the area of detection. The single device is able to illuminate the visual indicator in a color desirable by the user.

In accordance with one embodiment of the present invention, a signaling includes an audio device that generates an output such as a tone and/or a voice with the output selected based upon a status level and a light emitting diode (LED) strobe configured to illuminate in a variety of colors, where an illumination of a specific color is based upon the status level.

In accordance with another embodiment of the present invention, A method for indicating a status level includes activating an audio device with an output such as a tone and/or a voice, wherein the output is selected based upon the status level and activating an LED strobe configured to illuminate in a variety of colors, wherein the illumination of specific color is based upon the output.

In accordance with yet another embodiment of the present invention, a system for indicating a status level includes means for generating audio in response to an output selected from the group consisting of a tone and a voice, the output is selected based upon the status level and means for generating a LED strobe, the means for generating is configured to illuminate in a variety of colors, wherein an illumination of a specific color is based upon the output.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
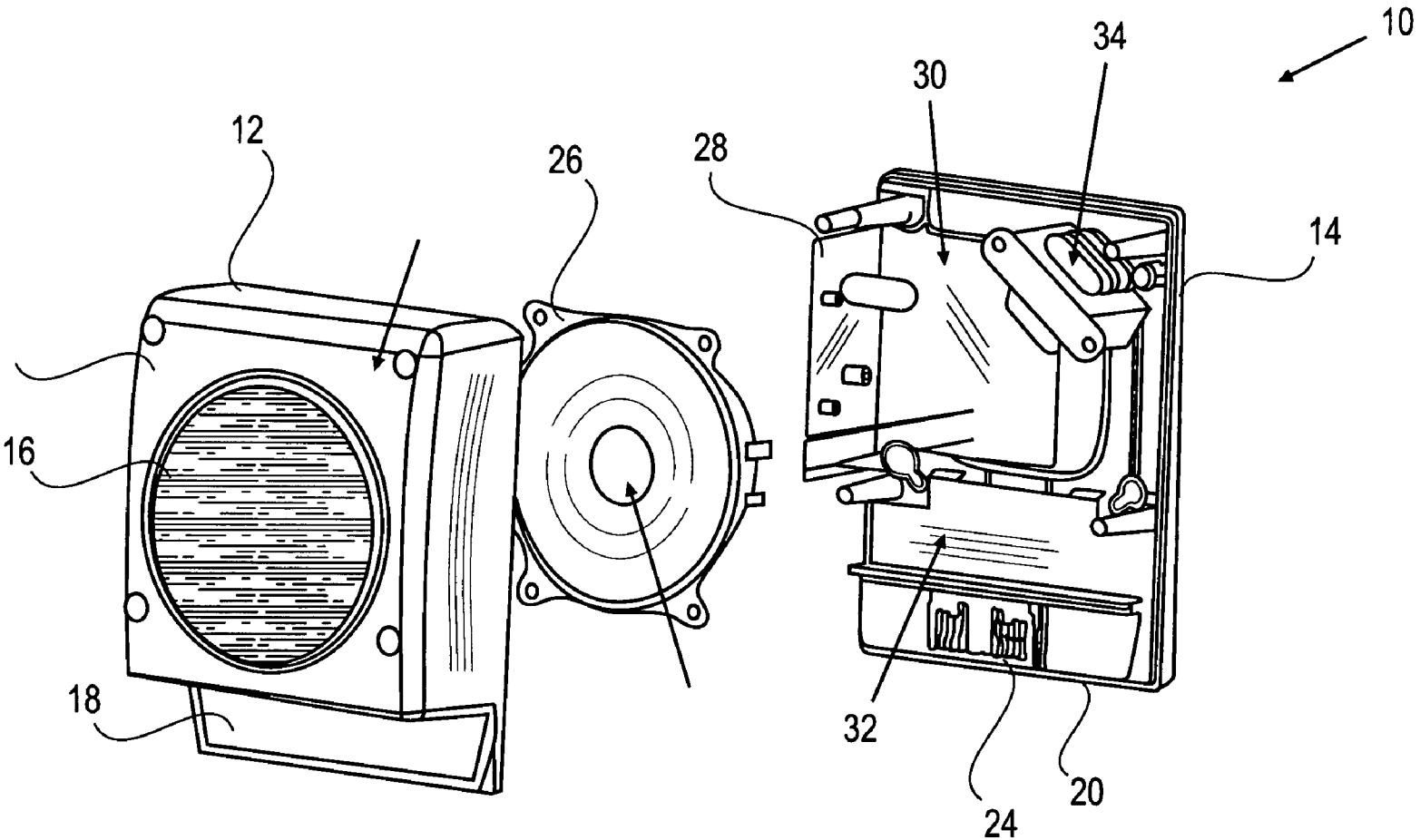
FIG. 1 is an illustration of the preferred embodiment of the present invention.

The invention will now be described with reference to the drawing figures, in which like reference numerals refer to like parts throughout. An embodiment in accordance with the present invention provides a system whereby multi-audio selections and multi-color displays are used in conjunction with one another to indicate a present condition or event such that individuals in the area are apprised and take appropriate action if necessary.

An embodiment of the present inventive apparatus and method is illustrated in FIG. 1. The apparatus 10 of the present invention includes of plurality of components. The apparatus 10 contains a front housing 12 and a rear housing 14 in order to contain the elements for the apparatus to function.

The front housing 12, in the preferred embodiment, includes a speaker grill 16 and a strobe assembly area cut out 18. The speaker grill 16, in the preferred embodiment, is used to allow any audio sounds or tones generated by the apparatus 10 to pass through the apparatus 10 more clearly or distinctly. Without the use of the speaker grill 16, sounds becomes muffled, less clear and distinct.

Another benefit of the speaker grill 16 is its ability to allow ambient air to pass through the apparatus 10. The importance of the free flow of air is that some of the elements contained within the apparatus 10 create heat. This heat can have performance deteriorating effects on some of the elements of the apparatus 10.

The strobe area assembly area cut out 18, in the preferred embodiment, is a cut-away such that the strobe assembly 20 is positioned within the cut-away once the front housing 12 and the rear housing 14 are attached. Once attached, the strobe assembly 20 is substantially flush with the outer face 22 of the front housing 12.

The rear housing 14, in the preferred embodiment, is the location for which a number of components of the apparatus are attached. At the bottom portion 24 of the rear housing 14, the strobe assembly 20 is positioned such that it is encompasses a substantial portion of the width of the apparatus 10. The height of the strobe assembly 20, in the preferred embodiment, is selected such that the highest availability with the minimum number of illuminating device are used.

The rear housing 14 also includes a speaker 26 that is positioned above the strobe assembly 20. The speaker 26, in the preferred embodiment, is selected such that it is able to deliver clear and audible voice and prerecorded tones. In alternate embodiments, the quality of the speaker 26 is selected based upon the desired output. In some embodiments, the quality of the output coming from the speaker 26 is less important than merely delivering the sound.

The rear housing 14 further includes a main board or motherboard 28 and a daughter board 30. The motherboard 28, in the preferred embodiment, is for low power amplification. The daughter board 30 interfaces to the motherboard 28 and the speaker 26. The purpose of the daughter board 30 is to provide some form of audio to the amplifier output stage. For example, if a tone board is used, then the apparatus 10 produces a dipswitch-selected tone upon power up of the unit. Similarly, if a voice board is used, then a pre-recorded voice message is played in a user defined period of time.

The rear housing 14, in the preferred embodiment, further contains a strobe board 32 that is linked to the strobe assembly 20 and the tone or voice board via hardwiring. The strobe board 32 enables the strobe assembly 20 to illuminate in a number of different colors. Control wiring to the strobe assembly 20, in the preferred embodiment, is done using multi-conductors, one for each respective LED color and a common. In alternate embodiments, data signals and power are transmitted with a single pair of wires. Note that in further alternate embodiments, the strobe assembly 20 is able to communicate with the various boards in a wireless configuration such as through radio frequency, BLUETOOTH, infrared and so on.

A step down transformer 34 is attached to the rear housing 14 in high voltage applications in order to connect the strobe assembly 20 to the Fire Alarm Circuit (not shown). In low voltage applications, the strobe assembly 20 is directly connected to the Fire Alarm Circuit.

Figure 2:
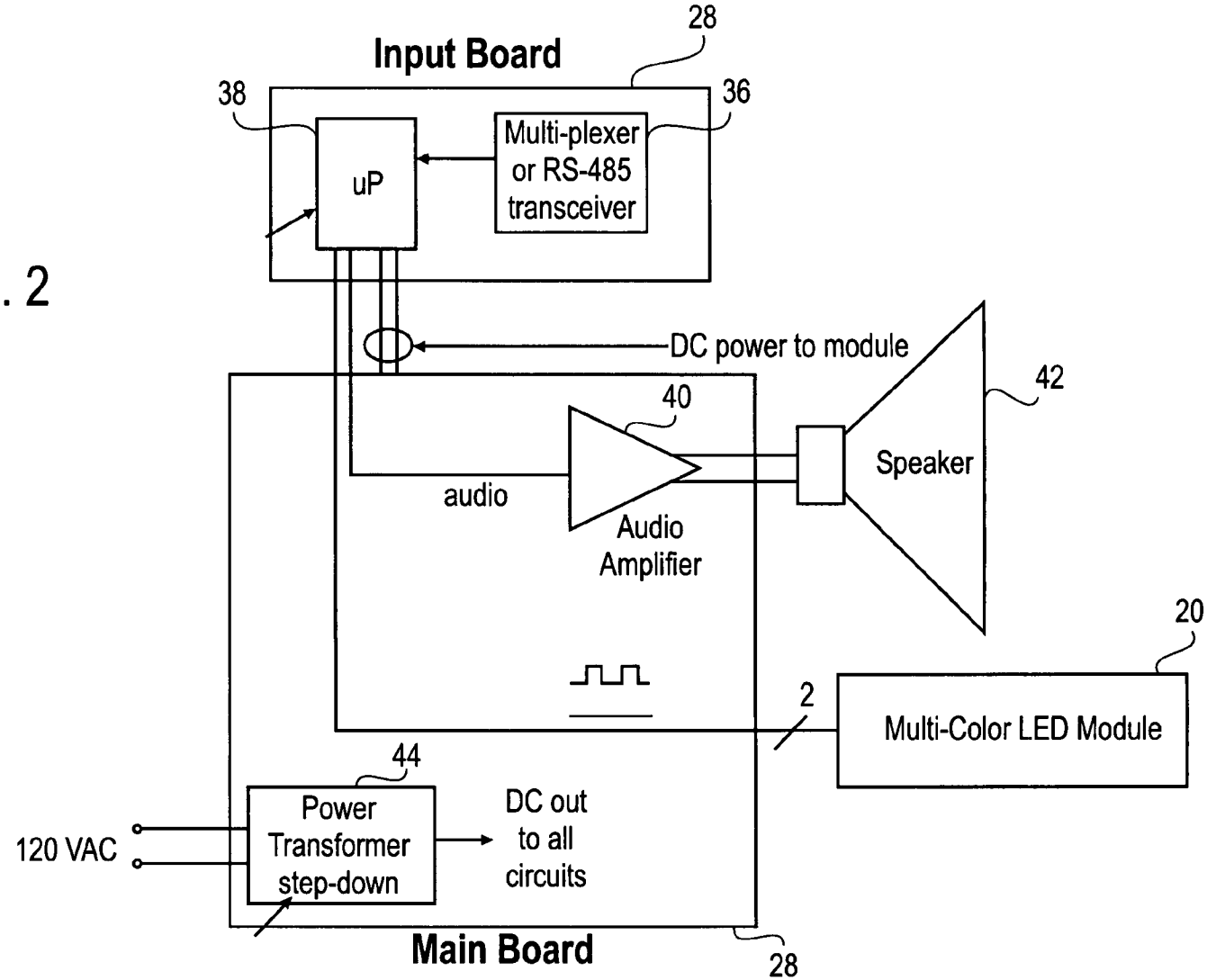
FIG. 2 is a block diagram illustrating the preferred embodiment of the present invention.

FIG. 2 is a block diagram illustrating the preferred embodiment of the present invention. The present invention includes a daughter board 30, which includes a multiplexer 36 or a transceiver (e.g., RS-485) and a microcontroller 38. In the preferred embodiment, the multiplexer 36 initiates a tone or voice request, which is then transmitted to the microcontroller 38. The multiplexer 38 receives these requests from a central station such as a fire or security system or any other type of system capable of generating the request. For example, if the apparatus 10 is linked to a machine and illuminates and/or activates the audio portion during different operating modes, then the apparatus 10 receives a signal or data from the machine indicating that it is operating in such manner. Upon reception of the data at the multiplexer 36, it is transmitted to the microcontroller 38, which analyzes the data in order to determine how to activate the apparatus 10. The microcontroller 38, in the preferred embodiment, is generally used to generate tones, handle the input request from the multiplexer 36 and transmit LED data to the strobe assembly 20. The LED data, in the preferred embodiment, is transmitted serially.

The requests received by the multiplexer 36 could be transmitted in a number of different configurations. In the preferred embodiment, the requests are received via dry-contacts. Alternate embodiments include wireless and RS-485 protocol driven.

Power to the strobe assembly 20 is received or transmitted through the microcontroller 38. In the preferred embodiment, the power and data are carried over the differing pairs of wires. However, it is highly desirable in alternate embodiments, to transmit power and data over the same two-wire pair to the strobe board 32. The strobe board 32 decodes the data and illuminates the respective color segment. The use of a common line achieves a low wire count, in exchange for which the wiring functions as a comparatively effective transmission line.

A typical single pair transmission operational scheme compatible with an embodiment of the invention could take the form of a command or data request message with the form—

<STX><U><A><F1><F2><F3><F4><F5><ETX><ck1><ck2>

. . . where <STX> is a single byte start-of-text message, <U><A> is a two byte unit address (00-FF), while <F1>, <F2>, <F3>, <F4>, and <F5> is single byte data fields, <ETX> is a single byte end-of-text field, and <ck1> and <ck2> is a two byte checksum.

Regarding timing for this example, bit time at 19.2 Kbits/sec is just over fifty-two (52) microseconds per bit. With eleven (11) bytes transmitted from the microcontroller 38, the total transmission time is roughly ((11 bytes×8 bits/byte)×52 microseconds per bit=4.58 msec. Response time of the strobe board 32 is likewise 4.58 msec because it also contains 11 bytes. Total time for a transmit and response is 4.58 msec×2=9.16 msec. If there are multiple internal components connected to the single pair of wires, then the total transmission time is calculated by multiplying the number of components by 9.16 msec. At this speed, the strobe board 32 switch closures can be detected with a high level of reliability.

As an example, a request has been received requires the strobe assembly 20 to illuminate in a yellow color. The request from the microcontroller 38 could send out the following message having a series of ASCII characters:

<STX>0243000<ETX>5C

In the above example, the microcontroller 38 is transmitting the data to address, 02. The address, in this embodiment, is more necessitated by having more than one component connected to a share communication medium. In a single component device, the address is optional.

The F1 and F2 fields contain the command 4 3, which has been designated as the illumination command, and fields F3, F4, and F5 are padded with zeroes as they are not needed in the illumination command. The message terminates with <ETX> and is then followed by a two-byte block checksum.

In this example, the block checksum is calculated to be 5C as follows. Each byte is converted to its hexadecimal value, after which a summation proceeds, starting at the <U> byte and ending with the <ETX> character. <STX> has a hexadecimal weight of 02 h and the <ETX> character has a weight of 03 h. Dropping the high byte in the resultant leaves the lower two bytes, with a value of 5C (hex).

When the strobe board 32 receives the command, it calculates the block checksum and compares it to what was sent from the microcontroller 38. If the two checksum values match, the message is presumed to be error free and ready for processing. However, if the checksums differ, the strobe board 32 can transmit a <NAK> character, for example, to indicate that a corrupt message was received. In response, the microcontroller 38 can retry the transmission, for example up to a set number of times. If the message continues to arrive corrupted, the microcontroller 38 can identify fault indication on a network or through some type of external identification such as a warning light linking or an display readout. The fault indication can show which component in the apparatus 10 is experiencing trouble as well as the specific trouble or general identification of the fault. If the apparatus contains a display, then a fault code corresponding to a problem is display or the actual problem is displayed.

This is a typical method for generating a robust checksum for raising data transmission confidence. Other methods can provide lesser or greater levels of confidence, such as parity bits that provide rudimentary verification, data encryption routines that can identify many specific single and multiple bit faults in short messages and can allow some trouble-shooting of a data path, and error correcting codes that can in some configurations allow operation in an electrically noisy environment.

The following 11 byte message can be the strobe board's 32 response to the polling message above:

<STX>0243100<ETX>5D

The <STX><U><A><4><3> can be an echo what was received by the satellite controller 212. The F3, F4, and F5 fields can be populated with the unit's current status. See Table A for a typical status indication field description.

TABLE A

| Status Indication Fields | | | |
|---|---|---|---|
| Status | F3 | F4 | F5 |
| No Action Req./Cancel | 0 | 0 | 0 |
| RED Illumination | 0 | 0 | 1 |
| Green Illumination | 0 | 1 | 0 |
| Amber Illumination | 0 | 1 | 1 |
| Yellow Illumination | 1 | 0 | 0 |
| Tone | 1 | 0 | 1 |
| Recorded Voice | 1 | 1 | 0 |
| Sound and Voice | 1 | 1 | 1 |

The decoding and verification process for the returned message may be essentially symmetrical with that for command message. Checksum errors in a returned message may result in the microcontroller's retransmission of a data request message.

System initialization after application of power may include a configuration check in which the microcontroller 38 transmits every possible address, requesting switch status of each address and its components. Barring failures, an exhaustive search may be expected to detect that all of the addresses previously in use (and stored in flash ROM) respond with an indication that no switches or components are activated. Many system malfunctions may be detected in this way, since depowered or misprogrammed components or strobe boards 32 may fail to respond or may respond incorrectly, and stuck switches, or their equivalents, can be expected to show up as active where none such are expected. Such a test can also be activated by selection from a functional menu if implementation of such features in a particular embodiment is desired.

Referring back to FIG. 2, the main board is further linked to the audio amplifier 40, which is connected to a speaker 42. The speaker 42, in the preferred embodiment, has an output capacity of two (2) watts. The daughter board 30 to which the microcontroller 38 is connected provides a form of audio to the amplifier stage. For example, if a tone board is used, then the speaker 42 produces a dipswitch-selected tone upon power up of the unit. Similarly, if a voice board is used, then a pre-recorded voice message is played in a pre-determined fashion. If the strobe assembly 20 is used in conjunction with the tone or voice, the strobe assembly 20 is energized during playback and remains energized as long as power is applied to the unit.

A power transformer 44 is included in alternate embodiments of the present invention. The power transformer 44 is used in conjunction with power sources of 120 volts AC. The power transformer 44 is used to transform the AC power supply into a DC power supply, which is then used by the apparatus 10 for the components contained therein.

Figure 3:
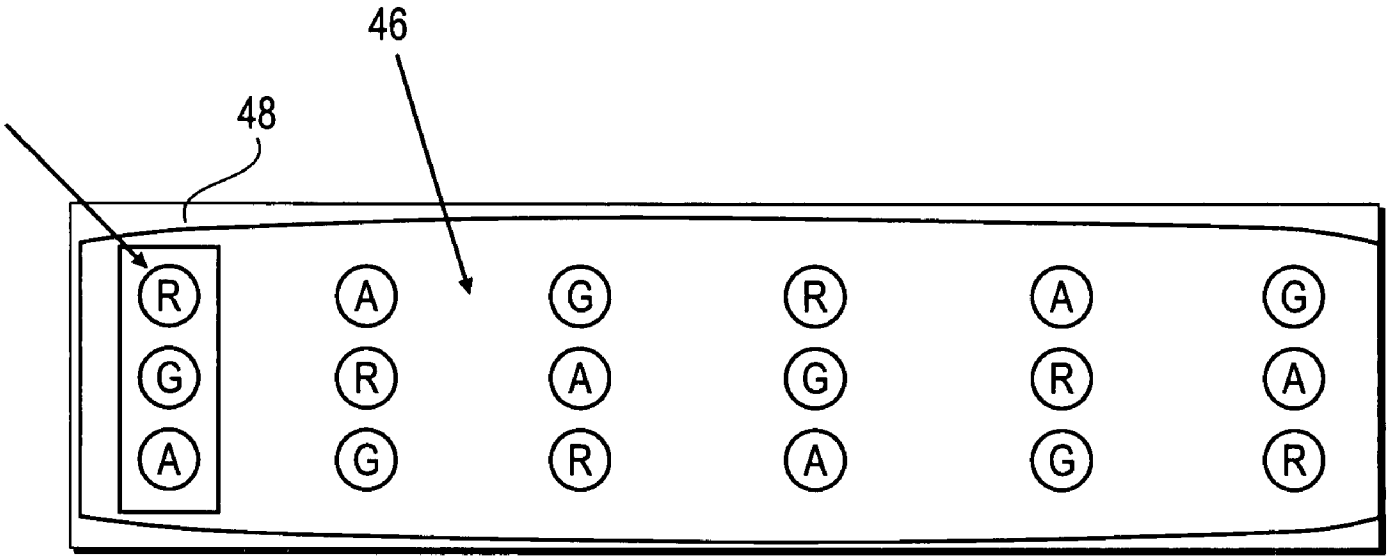
FIG. 3 is front view of the light emitting module incorporated in the preferred embodiment of the present invention.

FIG. 3 is front view of the strobe assembly 20 incorporated in the preferred embodiment of the present invention. The strobe assembly 20, in the preferred embodiment, includes a number of LEDs, which are preferably over other lighting devices such as incandescent. The life span of the LEDs are exponentially longer and therefore require less maintenance.

The strobe assembly 20, as depicted in FIG. 3, is made up of a number of different color LEDs, which are mounted upon a printer circuit board 46. The first column 48 includes, in order, a red, green and amber LED. Each column after this contains the same color LEDs but mounted in different configurations or order. The colors of the LEDs are staggered in order to obtain an even distribution of light.

Upon receiving a request to activate the strobe assembly 20, the LEDs are illuminated in such a configuration to achieve the requested color. In alternate embodiments, the color of the LEDs are instrumental in determining the range of colors available to the strobe assembly. If the LEDs are the three primary colors, red green and blue, then any color strobe assembly 20 can be achieved.

Examples of the present invention are plentiful but to illustrate the present invention, an example is presented using the apparatus 10 in a manufacturing environment. The example is provided for illustrative purposes only. It is noted that the present invention is not limited by this illustration.

In the manufacturing example, the present invention is located on the outside of a chamber in which potentially dangerous activities are taking place. The present invention is connected to the machine such that it is aware of the various states and is able to communicate this states in a visual or audio means.

If this manufacturing process is the machining of a metal part with a laser, the apparatus 10 is preferably located on the outside of the machine. During the use of the laser, a red strobe could be used to indicate to the operator and those within the area to not enter the chamber or stay away. The red strobe can also be used with an audio message that delivers a message in a repetitive fashion stating the following:

CAUTION: LASER IN USE.

Another example of the present invention is using it to indicate the current homeland security status that is kept by the U.S. Department of Homeland Security. The apparatus is linked remotely to the Department of Homeland Security and then indicates the current reported status. Upon receiving the status, the strobe is illuminated in said fashion. The strobe can be used to announce the status in a repetitive status or just at the time the security level has changed.

In the Homeland Security example, the present invention receives a request and analyzes the request. From this analysis, the present invention determines which devices to activate on the apparatus 10. How it activates is previously determined and programmed into the apparatus 10. Once the device completes its analysis of the request, the apparatus activates either or both the visual and audio indications.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A signaling apparatus, comprising:

an audio device configured to generate at least one output selected from the group consisting of a tone and a voice, the output is selected based upon a status level; and a light emitting diode (LED) strobe configured to illuminate in a variety of colors, where an illumination of a specific color is based upon the status level.

2. The signaling apparatus as in claim 1, wherein the LED strobe is detachable.

3. The signaling apparatus as in claim 1, wherein the audio device and the LED strobe are located within a housing.

4. The signaling apparatus as in claim 1, further comprising a motherboard interfaced to the audio device.

5. The signaling apparatus as in claim 1, further comprising a motherboard interfaced to the LED strobe.

6. The signaling apparatus as in claim 4, further comprising a daughter board interfaced to the motherboard, wherein the daughter board provides the output to the motherboard.

7. The signaling apparatus as in claim 5, wherein the motherboard is configured to provide the output to the audio device.

8. The signaling apparatus as in claim 5, wherein the motherboard is configured to provide the output to the LED strobe.

9. The signaling apparatus as in claim 8, wherein the LED strobe is linked to the motherboard with multiple conductors.

10. The apparatus as in claim 8, wherein the LED strobe is linked to the motherboard with no more than two wires.

11. The signaling apparatus as in claim 10, wherein the two wires are configured to serve as a medium for both power and control.

12. The signaling apparatus as in claim 1, wherein the voice is prerecorded.

13. The signaling apparatus as in claim 1, wherein the status level is an indication of at least one selected from the group consisting of a piece of equipment, an environmental condition, event, security level, operation level, time hazard and procedure level.

14. The signaling apparatus as in claim 1, wherein the LED strobe comprises a plurality of different color light emitting diodes.

15. The signaling apparatus as in claim 13, wherein the different color light emitting diodes are positioned to provide an even distribution of light.

16. A method for indicating a status level, comprising:

activating an audio device with an output selected from the group consisting of a tone and a voice, the output is selected based upon the status level; and activating a light emitting diode (LED) strobe configured to illuminate in a variety of colors, an illumination of specific color is based upon the output.

17. The method as in claim 16, further comprising transmitting the output from a control board.

18. The method as in claim 17, wherein the output is transmitted with no more than two wires.

19. The method as in claim 18, wherein power is carried along the no more than two wires.

20. A system for indicating a status level, comprising:

means for generating audio in response to an output selected from the group consisting of a tone and a voice, the output is selected based upon the status level; and means for generating a light emitting diode (LED) strobe, the means for generating is configured to illuminate in a variety of colors, wherein an illumination of a specific color is based upon the output.

21. The system as in claim 20, further comprising means for transmitting the output to the LED strobe.

* * * * *